United States Patent [19]

Wear et al.

[11] Patent Number: 4,830,272

[45] Date of Patent: May 16, 1989

[54] DISPLAY TRAY STRUCTURE

[76] Inventors: Philip A. Wear, 5900 Carter La., Minnetonka, Minn. 55343; Stuart C. W. Wear, 121 W. Grant St. #120, Minneapolis, Minn. 55304

[21] Appl. No.: 200,464

[22] Filed: May 31, 1988

[51] Int. Cl.[4] ..... B65D 5/48

[52] U.S. Cl. ..... 229/120.15; 229/120.07; 229/120.16; 229/195

[58] Field of Search ..... 229/120.07, 120.14, 229/120.15, 120.16, 122, 195

[56] References Cited

U.S. PATENT DOCUMENTS

| | | | |
|---|---|---|---|
| Re. 19,028 | 12/1933 | Sugerman | 229/29 |
| 419,621 | 1/1890 | Anderson et al. | 229/120.15 |
| 1,507,148 | 9/1924 | Bashwiner | 206/44 R |
| 1,515,741 | 11/1924 | Lyons | 206/44 R |
| 2,670,123 | 2/1954 | Frankenstein | 229/27 |
| 2,723,796 | 11/1955 | Malmgren | 229/120.16 |
| 2,797,855 | 7/1957 | Moore | 229/120.16 |
| 2,964,230 | 12/1960 | Nemoede | 229/120.16 |
| 3,086,691 | 4/1963 | Fobiano | 229/195 |
| 3,206,097 | 9/1965 | Holmes | 229/28 |
| 3,258,493 | 11/1966 | Coe et al. | 229/27 |
| 3,414,182 | 12/1968 | Fobiano | 229/120.15 |
| 3,606,004 | 9/1971 | Fruehwirth | 229/120.15 |
| 4,432,454 | 2/1984 | Bloom | 229/120.16 |
| 4,526,315 | 7/1985 | Muise | 229/120.15 |

FOREIGN PATENT DOCUMENTS

| | | | |
|---|---|---|---|
| 2457809 | 12/1980 | France | 229/120.14 |

*Primary Examiner*—David T. Fidei
*Assistant Examiner*—Gary E. Elkins
*Attorney, Agent, or Firm*—Leo Gregory

[57] ABSTRACT

A display tray structure for a food containing cabinet as in a grocery store, the tray being formed of a suitable fairly rigid bendable plastic material comprised of a blank having some portions cut out and others readily folded, the same being self-secured to form the walls and partitions and having openings for free circulation of cold air and the structure being impervious to the adverse effects of a frigid temperature.

6 Claims, 3 Drawing Sheets

DISPLAY TRAY STRUCTURE

BACKGROUND OF THE INVENTION

1. Field of Invention

This invention relates to a display tray as for a commercial type of a food display cabinet the tray being self formed of a blank.

2. Description of the Previous Art

The tray structure herein is particularly adapted for use in a food case or cabinet such as in refrigerated cabinets as in grocery stores, for an orderly separation and display of goods which are commonly visible through see-through doors. It has been noted that there appears to be an absence of such trays in general use.

SUMMARY OF THE INVENTION

This invention relates to a display tray to hold goods such as food items for sale in cases or cabinets such as the refrigerated cabinets of grocery stores. Such cabinets have see-through doors, the tray providing an orderly arrangement and separation of goods therein making the goods very readily identifiable. The use of such trays in a side by side relation provide for a clear separation of goods on display.

The tray of the invention herein is partitioned to hold goods and made them readily available throughout the full depth of the tray without requiring a reach to a full extent as into the refrigerated cabinet, the tray being slidable partially outwardly of the cabinet for access to the goods rearwardly of the tray.

The tray in its preferred form is a flat bank having cut out or slit portions and scored portions which are readily angled and inter-fit to be self-secured to form the walls and partitions of the tray.

It is an object of this invention to provide a display tray structure which in a preferred form is a flat blank having cut out or slit portions and scored portions which are readily angled and inter-fit to be self-secured to form the partitions and walls of the tray.

With reference to the previous object, it is a further object to provide a display tray of a fairly rigid plastic material such as polyethylene or vinyl which material appears to be impervious to refrigerated temperatures.

It is also an object of this invention to provide for the use of two or more of the display trays herein, said trays having their adjacent sides removably secured to one another for an array of trays to be disposed within a refrigerated cabinet for an orderly separation of goods display therein.

These and other objects and advantages of the invention will be set forth in the following description made in connection with the accompanying drawings in which the reference characters refer to similar parts throughout the several views.

BRIEF DESCRIPTION OF THE DRAWINGS

FIG. 1 is a plan view of a blank of the invention herein;

DESCRIPTION OF A PREFERRED EMBODIMENT

Figure 2:
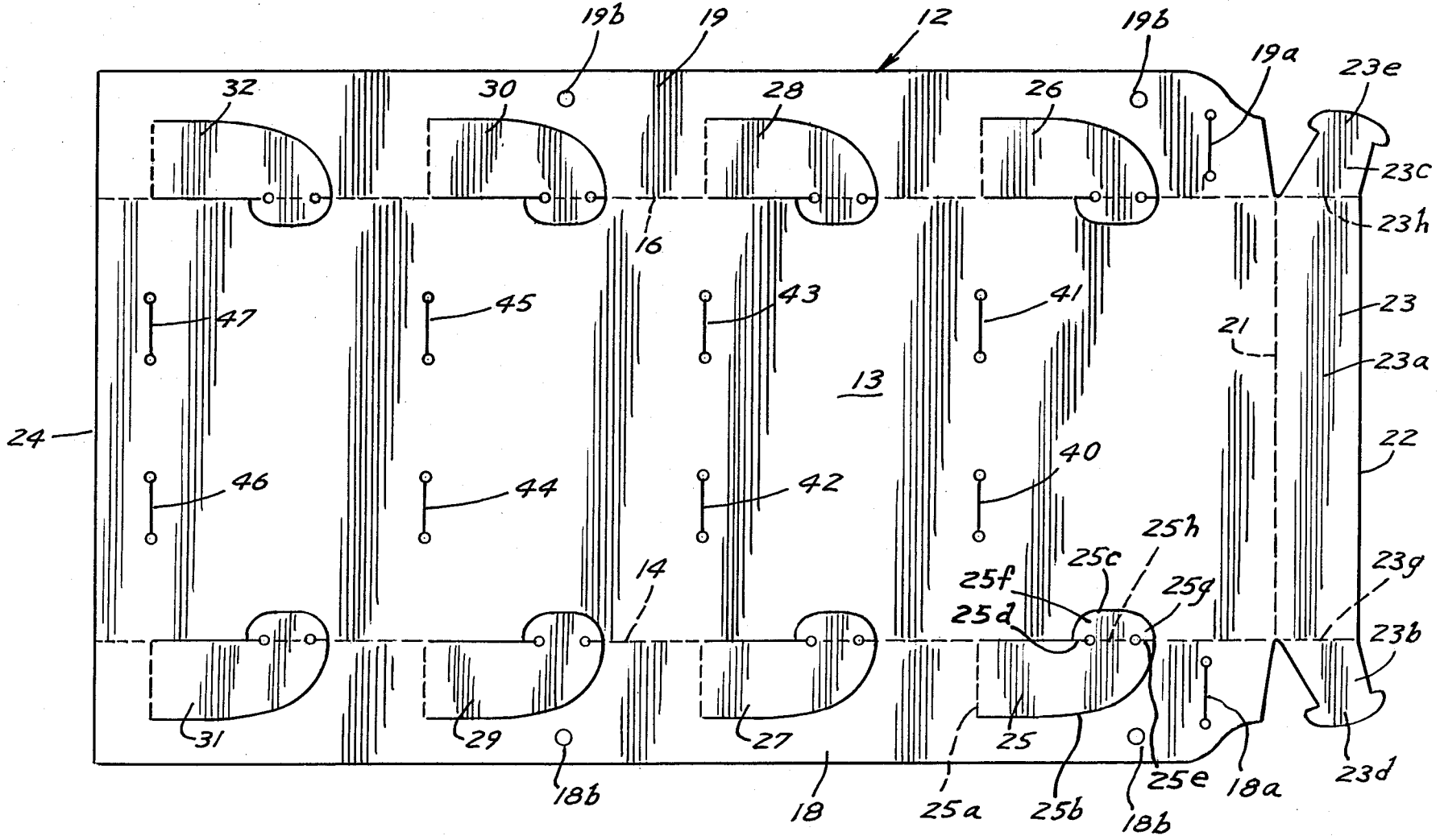
FIG. 2 is a view in perspective showing the invention herein in partially assembled form.
Figure 2:
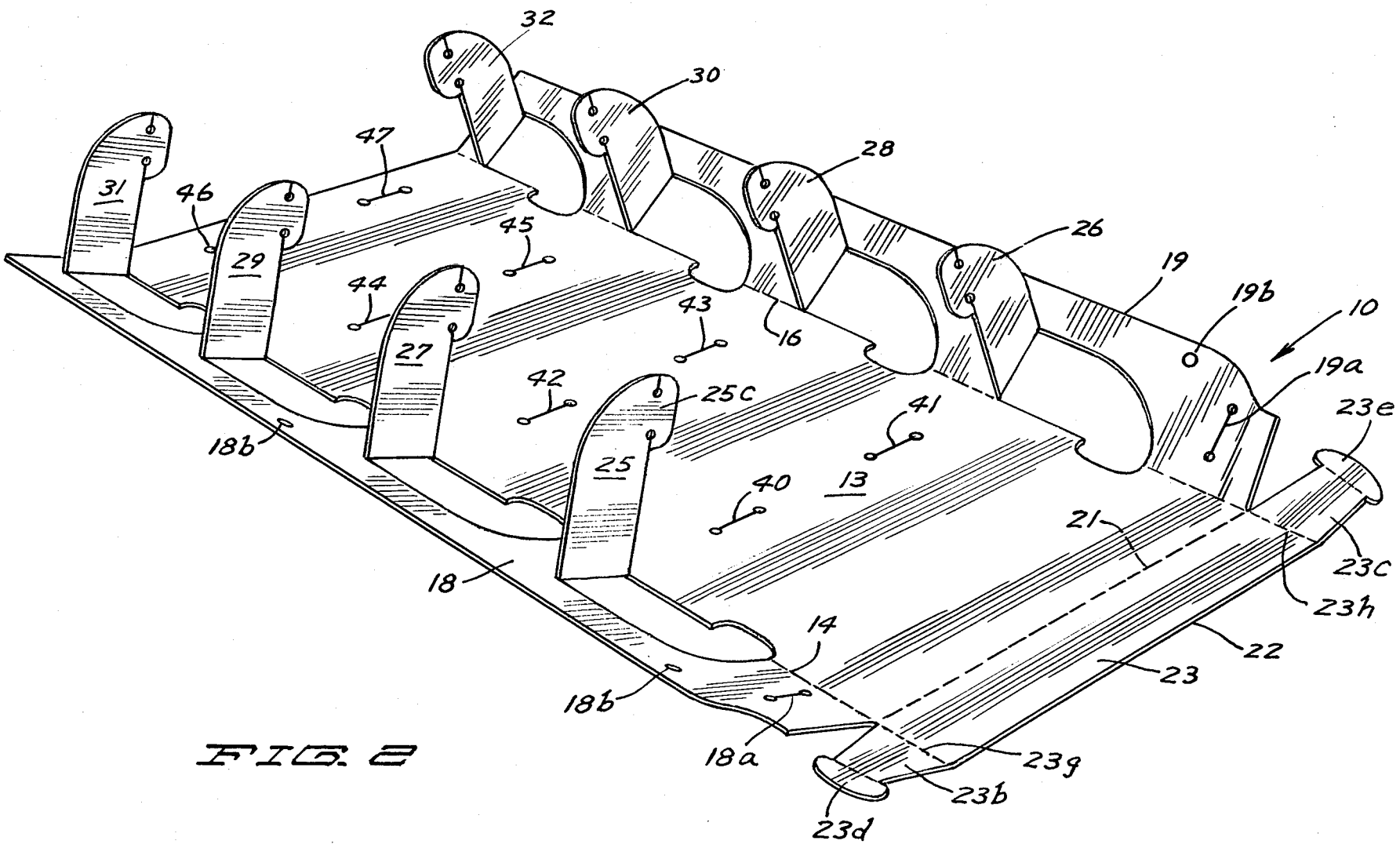

Referring to the drawings, the invention herein comprising a display tray structure is indicated generally by the reference character 10. With particular attention to FIG. 1, the tray structure herein in a pre-formed condition is shown in the form of a blank 12.

The tray may be formed of one of several suitable materials. Plastic material is particularly desirable in being relatively easy to form. More to the point the plastic materials of polyethylene or vinyl are readily extruded in a fairly rigid yet bendable state. These materials have been found to tolerate refrigerated temperatures without losing flexibility and form a very desirable tray.

Referring again to said blank 12, the same is seen to have a bottom wall 13 and to have longitudinally extending score lines 14 and 16 spaced inwardly of each side thereof to define side walls 18 and 19. A score line 21 spaced inwardly of the end 22 of said blank and extending thereacross defines an end wall 23. The end 24 of said blank in the embodiment here illustrated is shown here remaining as an open end in a flat condition. This is merely an illustration of one embodiment and does not preculude the use of an end wall.

Said end wall 23 has a central portion **23*a* and has end portions 23*b* and 23*c*, said end portions respectively being angled outwardly and being somewhat tapered as shown. Said end portions terminate in laterally extending hook portions 23*d* and 23*e***.

The tray structure herein embodies a plurality of opposed aligned pairs of partitions or dividers 25–26 through 31–32 transversely thereof which in the present embodiment, are formed or cut out for the most part from said side walls 18 and 19 as shown.

Said partitions may be variously shaped in plan for the purposes herein. The partition **25*a*** will be described in detail as representative of the other partitions.

Said partition 25 has a scored rear or end wall **25*a* and a full cut out portion of the remainder thereof with the top wall 25*b* tapering forwardly. A forwardly depending tab portion 25*c* is cut out of the adjacent portion of the bottom wall 13. Said tab portion has inwardly cut slits 25*d* and 25*e* to form undercut hook portions 25*f* and 25*g* and said tab is scored at 25*h*** for bending as will be further described.

Figure 3:
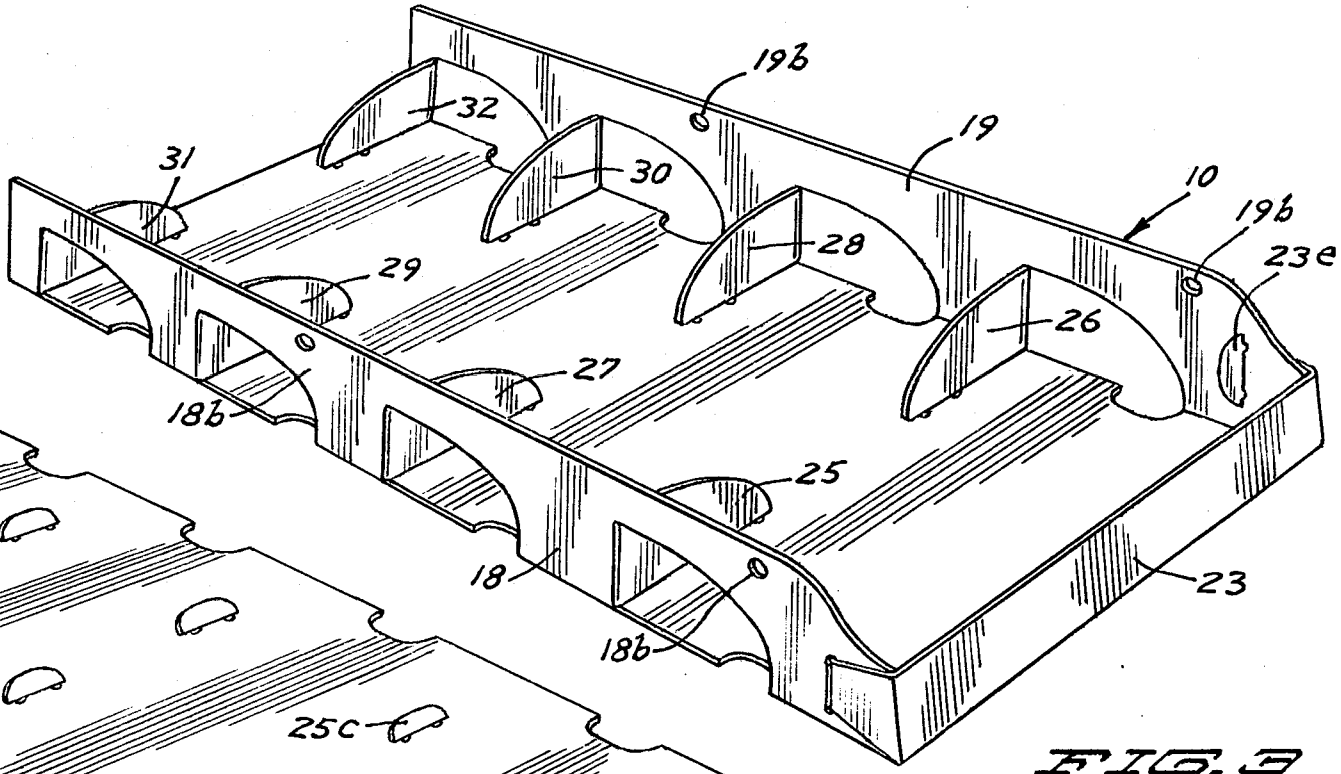
FIG. 3 is a view in perspective showing the invention in assembled form.

With the partitions 25–32 respectively being cut out, to form the tray, the side walls 18 and 19 are folded or bent upwardly along said score lines 14 and 16 to be at right angles to the bottom wall 13. See FIGS. 2 and 3.

The partitions are angled outwardly from their respective rear walls to extend as opposed aligned pairs. To accomodate the tab **25*c* and the corresponding tabs of the other partitions, slits are cut out into said bottom wall 13. With respect to the partition 25, a slit 40 is formed of a length of the score line between the hook portions 25*f* and 25*g* of the partition 25 and slits 41–47** respectively are formed to receive the respective depending portions of the remainder of the partitions.

Figure 4:
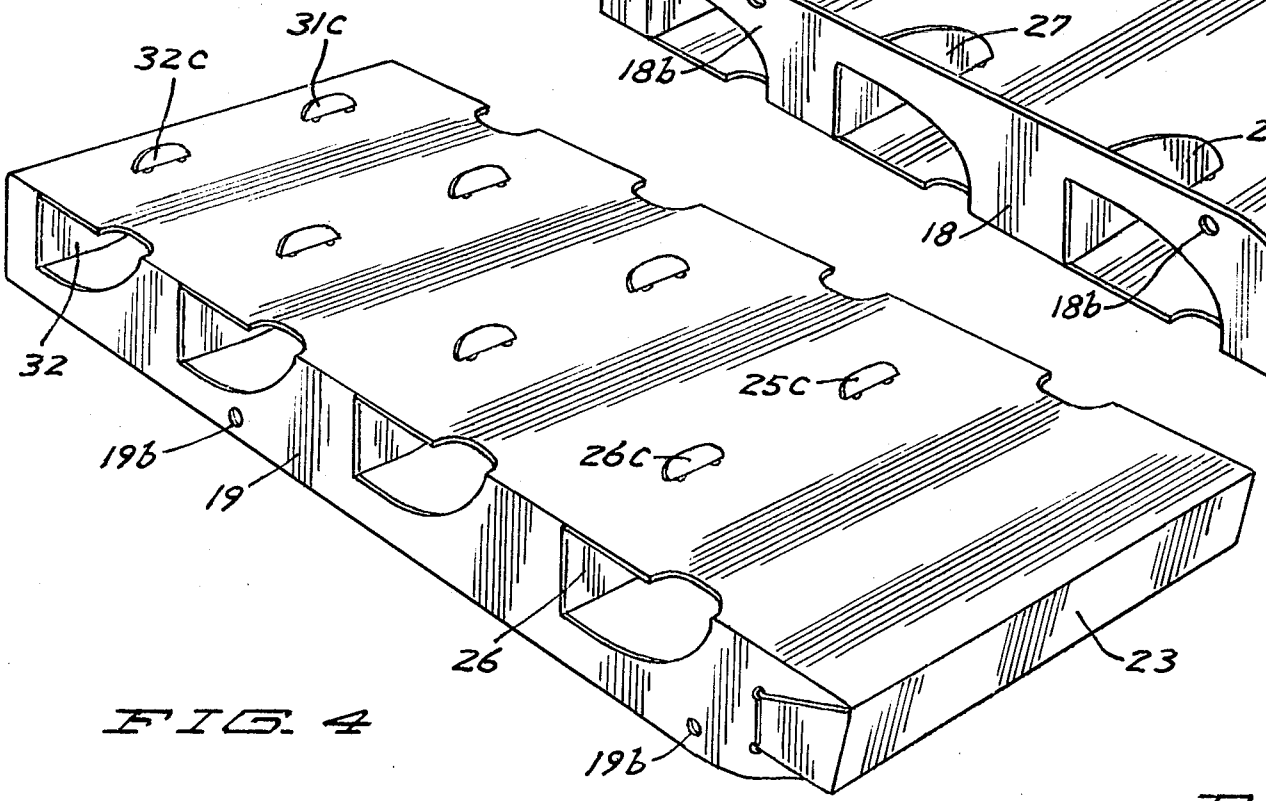
FIG. 4 is a view in perspective showing the bottom of the invention herein in assembled form.

To secure the side walls in upright position, the tab **25*c* and the respective tabs of the other partition members are disposed through their respective slits. There is sufficient flexibility in the material used to flex the tabs to shorten their lengths sufficiently to slip them through their respective slits. The hook portions as 25*f* and 25*g* of the partition 25 extend beyond the slit at each end thereof to retain the tab. The tabs may be seen protruding through the bottom wall 13 in FIG. 4** and yield or bend to lie flat against the outer surface of said bottom wall.

The end wall 23 is folded upright along the score line 21 and the extended end portions 23*b* and 23*c* are folded forwardly on their respective score lines 23*g and 23h* to overlie the adjacent end portions of the side walls 18 and 19.

To accomodate and receive the terminal hook portions 23*d* and 23*e*, slits 18*a* and 19*a* are formed in said adjacent ends of said side walls and hook portions 23*d* and 23*e* respectively are disposed therethrough in locking engagement.

Figure 5:
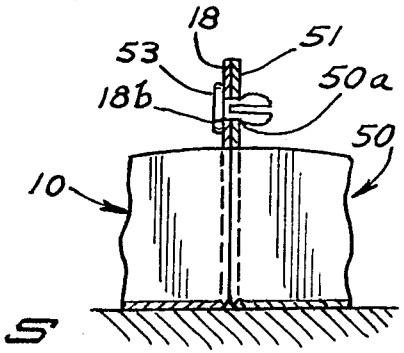
FIG. 5 is a broken view in section of a detail of structure.

Said side walls 18 and 19 are shown having small spaced apertures 18*b* and 19*b* therein for the purpose of securing a pair of trays in a side by side position. This is indicated in FIG. 5. Shown are trays 12 and 50 having their respective side walls 18 and 51 in abutting position with a compression pin 53 disposed through aligned apertures 18*b* and 50*a* securing said walls.

In the embodiment above described, the partitions have been shown to be cut or formed out of the side walls of the tray structure. In the alternative said partitions may as readily be cut out of the bottom wall 13 of said tray stucture with the bottom wall of each partition folded on a line at right angles to its adjacent side wall and each having a hook portion such as 25*c* cut out of the adjacent side wall and inserted through an accommodating slot in the side wall. However the structure first above described is regarded as a preferred structure.

Said tray will be of a size to fit nicely into a food display cabinet such as a refrigerated cabinet and to have a length to extend to full depth of a cabinet.

It is very convenient to draw a tray forwardly for ready access to items further back on the tray in the cabinet.

The tray structure has had excellent acceptance in market testing.

It will of course be understood that various changes may be made in form, details, arrangement and proportions of the parts without departing from the scope of the invention herein which, generally stated, consists in an apparatus capable of carrying out the objects above set forth, in the parts and combination of parts disclosed and defined in the appended claims.

What is claimed is:

1. A display tray structure as in a food display cabinet having a see-through door, having in combination a blank substantially rectangular in plan forming a bottom wall defined by an end wall and opposed side walls, said end wall having a tab extending from each end thereof and said tabs having hooks formed at their outer ends, said tabs being bent to respectively overlie adjacent end portions of said side walls, said end portions of said walls having slits therein to receive said hooks for said tabs, a plurality of partitions spaced longitudinally of said side walls respectively being formed as cut outs from adjacent portions of said blank, said partitions being angled inwardly of said side walls transversely of said bottom wall and respectively extending between said side walls, a hook portion depending from the free end portion of each of said partitions, and slits in an adjacent wall to receive said hook portions of said partitions.

2. The structure of claim 1, wherein said partitions are in opposed aligned paired relationship.

3. The structure of claim 1, wherein said partitions extend partially between said side walls.

4. The structure of claim 1, wherein said hook portions are formed of portions of said bottom wall adjacent said side walls.

5. The structure of claim 1, wherein said tray is formed of a suitable plastic material.

6. The structure of claim 1, wherein said hook portions being undercut to extend through said slits and extend beyond the slit therethrough in locking position.

* * * * *